United States Patent [19]

Anderson

[11] Patent Number: 4,802,522

[45] **Date of Patent: * Feb. 7, 1989**

[54] SUPPORT FOR AN OPERATING ELEMENT OF A VENETIAN BLIND ASSEMBLY

[75] Inventor: Richard N. Anderson, Owensboro, Ky.

[73] Assignee: Hunter Douglas Inc., Saddle River, N.J.

[ * ] Notice: The portion of the term of this patent subsequent to May 5, 2004 has been disclaimed.

[21] Appl. No.: 15,268

[22] Filed: Feb. 17, 1987

Related U.S. Application Data

[63] Continuation-in-part of Ser. No. 725,456, Apr. 22, 1985, Pat. No. 4,662,422.

[51] Int. Cl.[4] ..... E06B 9/30

[52] U.S. Cl. ..... 160/168.1; 160/178.1; 160/126

[58] Field of Search ..... 160/168 R, 178 R, 166 A, 160/166 R, 345, 126; 16/93 R, 93 D

[56] References Cited

U.S. PATENT DOCUMENTS 4,572,380 2/1986 Langwell ..... 211/57.1

4,662,422 5/1987 Anderson ..... 160/168 R

*Primary Examiner*—Ramon S. Britts

*Assistant Examiner*—Blair M. Johnson

*Attorney, Agent, or Firm*—Pennie & Edmonds

[57] ABSTRACT

A support for an operating element of a vertical blind assembly when the blind assembly is in an open position. The support is positioned in a stationary manner with respect to a headrail and is adapted to be moved into and out of supporting engagement with the operating element. The supporting means comprises a single arm constructed of flexible material normally disposed in supporting engagement with the operating element and is adapted to be contacted by the travelers of the blind assembly. Such contact will cause the arm to bend out of engagement with the travelers to permit their continued movement along the headrail. The flexibility of the arm permits it to return to its supporting position when not engaged by any traveler.

6 Claims, 3 Drawing Sheets

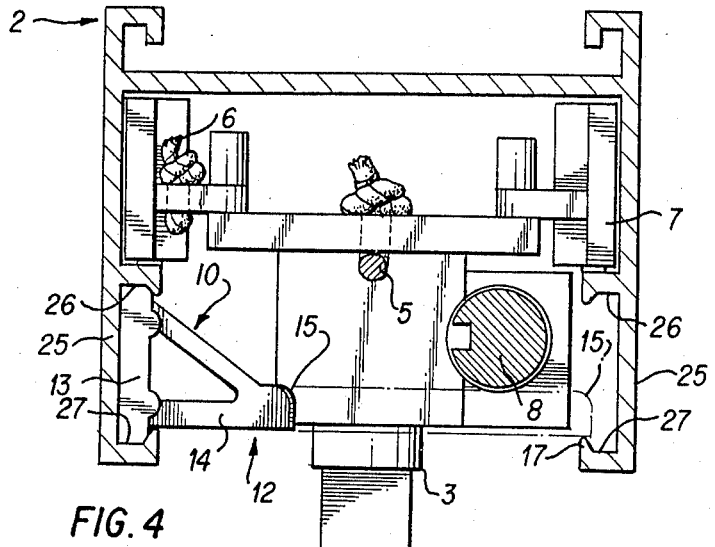
FIG. 4
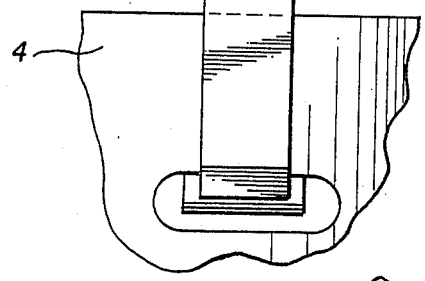
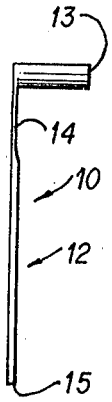
FIG. 6
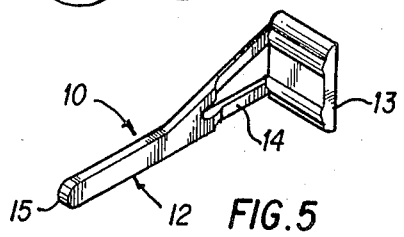
FIG. 5
FIG. 7
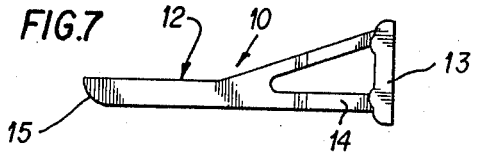

SUPPORT FOR AN OPERATING ELEMENT OF A VENETIAN BLIND ASSEMBLY

RELATED APPLICATIONS

This application is a continuation-in-part of applicant's copending application Ser. No. 724,456 filed Apr. 22, 1985, now U.S. Pat. No. 4,662,422, and the disclosure of which is incorporated herein by reference.

FIELD OF THE INVENTION

This invention relates to a support for an operating element of a vertical blind assembly and more particularly to a support which is mounted or fixed in a stationary position with respect to a headrail and which is movable into and out of supporting engagement with the operating element as the blind assembly is moved to and from open and closed positions.

BACKGROUND OF THE INVENTION

Vertical blind assemblies, for example, vertical venetian blinds which extend over a wide window or door opening, often have operating elements, i.e., a rotatable shaft or operating cords, which extend over the width of the opening to which the blind assembly is applied and which are used to provide means for opening or closing the blind assembly and/or to tilt the slats of the assembly. Where the width of the opening is large, the operating element or elements may tend to sag if no means are provided for supporting the same. This may in turn lead to an unsightly appearance and even to difficulty in operating the blind assembly.

In conventional vertical venetian blind assemblies, individual slats are supported by slat support means in the form of travelers where the travelers are movable along and are supported by a headrail. The travelers also may support the operating element. Thus, when the blind assembly is closed, that is when the vertical slats of the venetian blind assembly extend across the width of the opening, the travelers themselves may provide means for supporting the operating element along the portions of its length. However, when the blind assembly is moved to an open position, that is when the salts are moved to one side of the opening, the travelers carrying the salts are also moved to one side of the opening thus removing support for the operating element. Where the operating element comprises a rotatable shaft, the shaft may tend to sag and in those instances where the element comprises one or more operating cords, the cords may sag.

Conventional vertical blind assemblies have overcome this sagging problem by providing for one or more support means for an operating element in the form of carriages which are moved along the length of the headrail as the blind is moved towards an open position to substitute for the support provided by the travelers as the travelers are moved towards the open position. The force necessary to move these carriages, when combined with that necessary to move the travelers, may in many instances become excessive and the hardware required for moving the carriages as well as the carriages themselves is relatively expensive and complicated to install, is not easily adjustable and often is not reliable in operation.

The same problems that exist with vertical venetian blind assemblies also may exist with draperies that are used to open and close window or door openings. In some instances the portions of the fabric comprising the drapery are carried by traverlers which are moved along a headrail by an operating element. This element may be subjected to the same bending and sagging problems that exist with vertical slatted venetian blind assemblies.

As disclosed in applicant's prior application Ser. No. 725,456, now U.S. Pat. No. 4,662,422, a plurality of separate supports are provided for a vertical blind assembly in which each support is movable into supporting engagement with an operating element to support the element along portions of its length when the blind assembly is in an open position and which is movable out of supporting engagement with the operating element when the blind assembly is moved to a closed position.

In construction, the support element comprises an arm adapted to move into and out of supporting engagement with the operating element of the blind assembly in response to movement of the lead traveler of the plurality of travelers. Preferably, the arm is L-shaped and includes a short leg and a long leg with the arm pivotal about an axis extending perpendicular to the juncture of the legs to pivot in a plane whereby the long leg may be moved into and out of supporting engagement with the operating element and whereby the free end of the long leg may engage a further portion of the headrail.

The support element is positioned so that the pivot axis is perpendicular to the longitudinal axis of the headrail such that the long leg is adapted to be engaged by the contact member, which is mounted on the lead traveler, when the lead traveler moves toward a blind closed position to pivot the arm and long leg out of supporting engagement with the operating element and such that the short leg is adapted to be engaged by the contact member when the lead traveler moves toward a blind open position to pivot the arm and long leg into supporting engagement with the operating element.

With the construction disclosed in applicant's prior application, it is possible, after the blind has been properly installed, for someone to reach up into the headrail with a finger, pencil, screwdriver or some other instrument and to activate the shaft support in the opposite direction to that in which it is supposed to be at the time. For example, if the blind has been fully extended to its closed position and someone reaches up to activate any one of the supports into a supporting mode, then when the operator chooses to move the blind to an open position, the first traveler beyond the mispositioned shaft support would eventually engage that support, and either the opening action would be abruptly stopped or the operator would have to exert enough force on the pull cord to drag the shaft support to the other end of the headrail. The reverse situation of course could occur when the blind is in an open position and someone reaches up and purposely or inadvertently activates any one of the shaft supports into the non-support mode.

BRIEF DESCRIPTION OF THE INVENTION

In accordance with the teachings of the present invention, the shaft support members are constructed so as to permit passing of the travelers through the support members.

In the preferred embodiment of the invention, the shaft support is constructed of a single arm rather than two arms. Each support member is attached to the headrail with the single arm in a normal supporting mode extending across the headrail to support the necessary operating member of the blind. With this construction, the arm is pivotally mounted as by being made of flexible or bendable material permitting pivoting or bending out of the way of each traveler as it engages the arm. After such engagement, the arm returns to its normal supporting mode. With this construction, it is not possible for one to improperly actuate the arm to a nonsupporting versus supporting mode. The arm is always in a supporting mode and is simply flexible to move aside as the travelers come into engagement therewith.

BRIEF DESCRIPTION OF THE DRAWINGS

FIG. 4 is an enlarged cross-sectional view of FIG. 3 taken along lines 4—4;

FIG. 5 is an enlarged perspective view of the support means illustrated in Fi. 1;

FIG. 6 is a top view of the support means shown in FIG. 5; and

FIG. 7 is a side view of the support means shown in FIG. 5.

DESCRIPTION OF THE PREFERRED EMBODIMENTS

Figure 1:
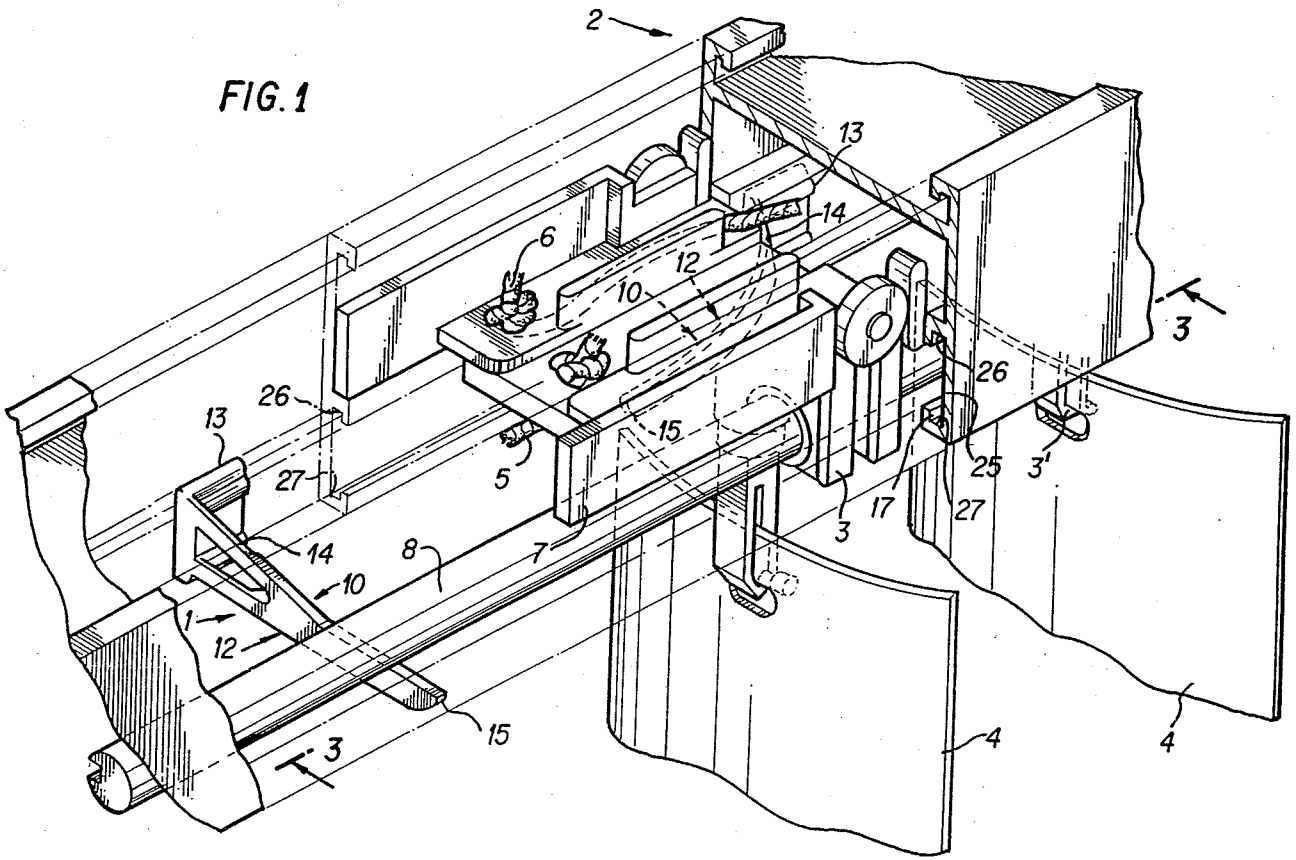
FIG. 1 is a broken perspective view of a vertical blind assembly constructed according to the invention.
Figure 2:
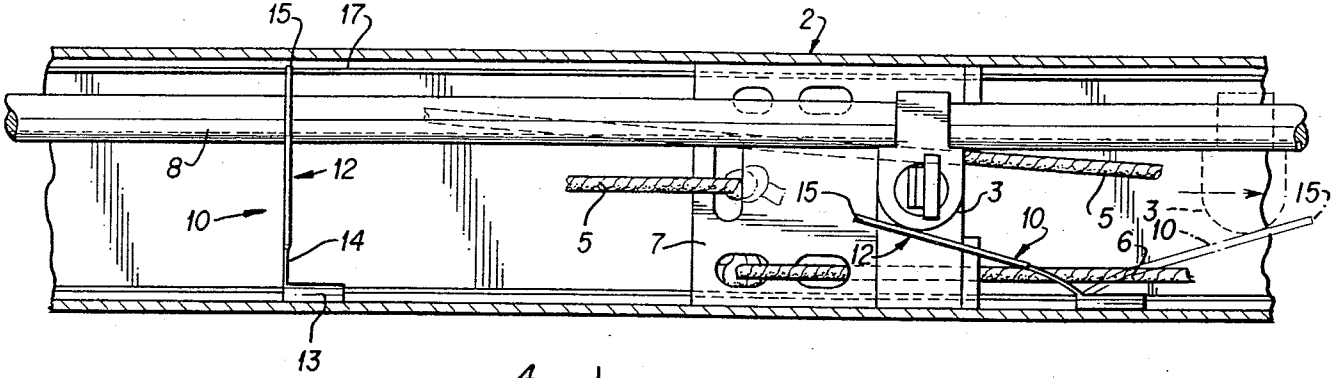
FIG. 2 is a bottom view of the blind assembly of FIG. 1.
Figure 3:
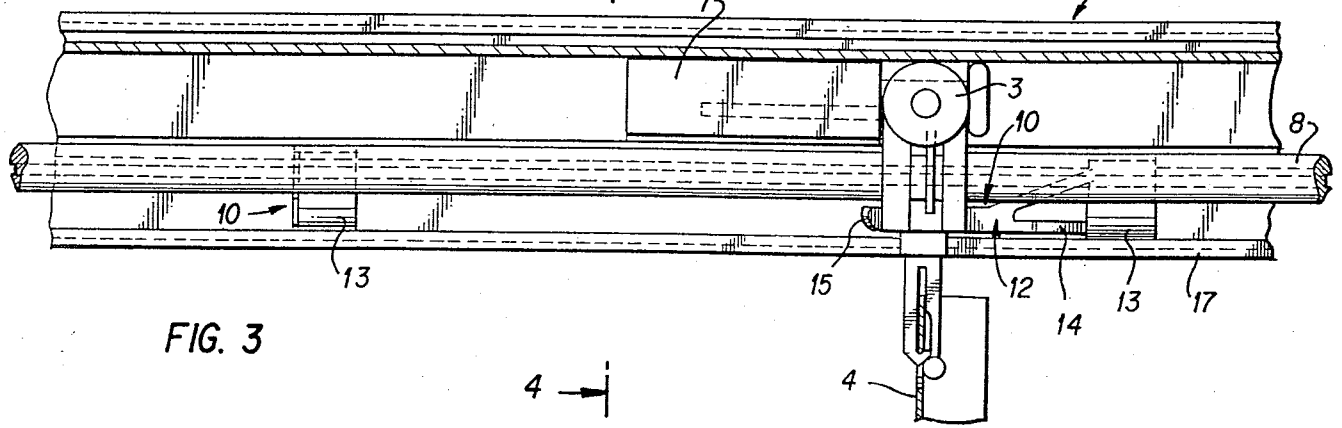
FIG. 3 is a broken front view of the blind assembly of FIG. 1 taken in the direction of the arrows 3—3 in FIG. 1.

Referring to the drawings and particularly to Figs. 1–3 there is disclosed a support 1 for supporting a vertical venetian blind assembly where the assembly includes a longitudinally extending headrail 2 having a plurality of travelers therein including a lead traveler 3 and a plurality of trailing travelers 3', only a portion of one of which is shown in FIG. 1. Each traveler individually supports a vertically extending slat 4. The lead traveler 3 is adapted to be moved longitudinally with respect to the headrail 2 by means of a blind closing cord 5 and a blind opening cord 6 which connect with a movable element in the form of a lead traveler bridle 7 in turn fixed to the lead traveler.

An opeating element in the form of an operating shaft 8 is positioned within the headrail longitudinally thereof and extends through each of the travelers including the lead traveler to be partially supported thereby.

A plurality of shaft support means 10 are spaced longitudinally in a stationary manner on the headrail 2 as shown in FIG. 2 and support the operating shaft 8 at intervals along its length when the travelers are moved to a blind open position and where the travelers themselves would be grouped at one or both ends of the headrail and be incapable of supporting the operating shaft at a middle or opposite end portion of the headrail.

Each shaft support means 10 comprises a single support element in the form of an arm 12 which, as shown in FIGS. 1 and 2, is adapted to pivot or bend into and out of supporting engagement with the shaft 8. The arm 12 extends from a resilient base portion 13 adapted to be fitted within a track 25 of the headrail. As shown in FIGS. 1 and 4, the track 25 includes engaging shoulders 26 and 27. The base portion is held in place by a compression or friction fit. This construction thus allows the base and arm to be snap-fitted into the track 25 and the resiliency of the base portion is sufficient to lock the base portion and arm into a stationary position longitudinally on the headrail at any desired position along the length of the headrail. It is obvious that other means could be utilized to fixedly position the base portion to the headrail.

The shaft support arm 12 extends at right angles from the base portion and terminates in a free end 15. The arm is designed in such a manner that with the material being used it has maximum flexibility in the horizontal direction and maximum rigidity in the vertical direction. The shaft support projects under and beyond the operating shaft 8 so that it engages the track 17 on the opposite side from where the base is suspended. The profile of the arm broadens rapidly as it approaches the base portion. The wall thickness of the support element is minimized for a short section 14 immediately adjacent the base portion and then is thickened up again from that point out to its free end, including the area where the shaft 8 is supported. Also, some material in the triangular shaped broadened area 14 is removed. This is accomplished without sacrificing the supporting strength in the vertical mode, but with an effect of making the support arm more flexible in the horizontal mode by virtue of having less material to flex.

The support member is constructed as a unitary member out of a flexible springlike material so as to be able to be easily pivoted or bent from side to side, without taking a permanent set and with a tendency to spring back to its original right angle position when any deflecting force is removed. It is also important to have the force required to cause such deflection to be so low as to be almost unnoticeable during the operation of the blind. The support member is also constructed of material which is not too hard so as to avoid any noise, if possible, during this deflection activity. To satisfy these requirements, the support member is preferably made of a suitable plastic material. As presently preferred, it is injection molded out of impact modified polypropylene. Alternatively, the support member can be made of other materials such as an extremely thin stainless spring steel.

Referring to FIGS. 1 and 2, it is seen that when the travelers 3 and 3' are pulled to the left by cord 5 toward the blind closed position, the lead traveler 3, and then each successive trailing traveler 3', will contact the free end 15 of arm 12 which is dispsoed in its path of movement. This will cause the arms to bend or pivot and move out of supporting engagement with the shaft 8. Means are further provided so that immediately after passage of the lead traveler, the free end of the arm will move back to its normal shaft supporting position. With the presently preferred construction of the invention, this means is defined by the thin short section 14 of the arm 12. This thin section facilitates flexing of the arm into and out of shaft supporting position. In operation, the force exerted on the free end 15 of the arm by the lead traveler and the subsequent travelers 3' will be sufficient to cause this flexing or pivoting of the arm out of the path of the traveler. When the blind is moved to its fully closed position, to the left as viewed in FIG. 1, support for the shaft is then provided by both the travelers 3 and 3' and the support means 10. When the blind is moved to the right as shown in FIG. 2 by the cord 6 to the blind open position, the other sides of the travelers 3' and 3 will engage successively against the free end 15 of the support arm 12 of each support member 10 to exert a different opposite force on each free end. This force will also cause flexing of each free end out of the path of the engaging traveler with subsequent and immediate return to its normal shaft supporting position. Thus, when the blind is moved to the fully opened position, the shaft support members 10 will each be in the supporting mode underlying and supporting the operating shaft 8.

With the above construction of the support members, it is no longer possible for one to inadvertently position the supporting arm 12 of the support means in an improper manner. Any inadvertent touching of the individual arms will simply flex them but they will always return to their normal supporting position.

While the supporting means has been described as being used with a blind assembly having a plurality of vertical slats, the same construction is usable with a blind assembly comprising a drape. In this instance the travelers would support or hold portions of the drape with the drape hanging vertically from the travelers.

Further while the supporting means have been described as engaging an operating shaft, they could also engage other operating elements, as for example, operating cords. Even in the structure shown, the support means 10 are available to support the cord 5 if for any reason it becomes slackened. It is also seen that a supporting means as described comprises a single part which is inexpensive to manufacture.

I claim:

1. A support for the operating means of a laterally movable blind assembly adapted to be moved to open and closed positions, where said blind assembly includes a plurality of vertically disposed portions each depending from a traveler supported by and movable along a longitudinal headrail extending at an angle with respect to the vertical direction, said operating means extending parallel to said headrail and in a closed position of the blind assembly being supported at intervals along the length of said headrail by said travelers, and means for moving said travelers towards open and closed positions of said blind assembly; said support being mounted in a stationary manner in at least one location along the length of said headrail, said support having a support element normally positioned in the path of movement of said travelers and in a supporting position with respect to said operating means, said support element being movable out of said supporting position and out of the path of movement of said travelers in response to engagement with said travelers, and means for moving said support element into said supporting position when not engaged by a traveler.

2. In a vertical blind assembly comprising a plurality of vertically disposed slats each depending from a traveler with each traveler being movably supported by and guided along a longitudinal headrail extending thereabove at an angle with respect to the vertical direction, operating means extending parallel to said headrail, means associated with a leading one of said travelers for moving said travelers towards open and closed positions of said blind, and at least one support adapted to support said operating means along the length of said headrail in an open position of said blind; the improvement wherein each of said supports is mounted in a stationary position along the length of said headrail and each support includes a support element defined by an arm disposed in the path of movement of said travelers and normally positioned in a supporting position with respect to said operating means and adapted to bend out of a supporting position and out of the path of movement of said travelers in response to movement of said travelers along said headrail, whereby each support is actuated directly upon contact by each of said travelers, and means for normally moving said arm into said supporting position at all times when not engaged by a traveler.

3. A support according to either of claims 1 or 2 wherein said support element is of flexible material having a normal shape extending in supporting position with respect to said operating means and being flexible into and out of said supporting position by engagement with any of said travelers.

4. A support according to claim 3 wherein each of said supports includes a base portion mounted on said headrail and an integrally formed arm defining said support element, said arm having a free end supporting said operating member and a thin flexible section adjacent the base portion permitting flexing of said arm upon engagement of a traveler with said free end.

5. A support according to claim 4 wherein there are a plurality of supports mounted along the length of said headrail.

6. A support according to claim 3 where each of said supports includes a base portion mounted on said headrail and an integrally formed arm defining said support element, said arm having a free end supporting said operating member and a thin flexible section adjacent the base portion permitting repeated flexing of said arm in either direction from its normal position as measured along the length of the headrail upon engagement of a traveler with said free end as the traveler moves in either direction along said headrail.

* * * * *